US007941984B2

(12) United States Patent
Roig et al.

(10) Patent No.: US 7,941,984 B2
(45) Date of Patent: May 17, 2011

(54) WIND FORCE RESISTANT STRUCTURE

(76) Inventors: Charles Roig, Roselle, IL (US); Daniel Roig, Cary, IL (US)

( * ) Notice: Subject to any disclaimer, the term of this patent is extended or adjusted under 35 U.S.C. 154(b) by 322 days.

(21) Appl. No.: 12/371,827

(22) Filed: Feb. 16, 2009

(65) Prior Publication Data

US 2010/0083607 A1 Apr. 8, 2010

Related U.S. Application Data

(60) Provisional application No. 61/103,011, filed on Oct. 6, 2008.

(51) Int. Cl.
*E04H 12/06* (2006.01)
*E04H 12/10* (2006.01)

(52) U.S. Cl. ..... 52/636; 52/633; 52/646; 52/634; 52/648.1; 52/651.1; 52/653.1; 52/654.1; 52/655.1; 52/662; 52/663

(58) Field of Classification Search ..... 52/79.1, 52/79.7, 79.8, 79.12, 238.2, 234, 633–637, 52/648.1, 690, 653.1, 651.01, 651.07, 655.1, 52/692, 653.2, 654.1, 662–663
See application file for complete search history.

(56) References Cited

U.S. PATENT DOCUMENTS

| | | | | | |
|---|---|---|---|---|---|
| 1,537,589 | A | * | 5/1925 | Dawson et al. | 52/223.9 |
| 2,481,821 | A | * | 9/1949 | Byrne et al. | 114/266 |
| 3,293,814 | A | | 12/1966 | Zugehor | |
| 3,461,633 | A | * | 8/1969 | Ziegelman et al. | 52/643 |
| 3,638,380 | A | * | 2/1972 | Perri | 52/79.12 |
| 3,818,654 | A | * | 6/1974 | Schramm | 52/79.7 |
| 3,834,681 | A | * | 9/1974 | Fordyce et al. | 261/111 |
| 4,030,611 | A | * | 6/1977 | Konstant | 211/191 |
| 4,178,736 | A | | 12/1979 | Salas | |
| 4,423,576 | A | * | 1/1984 | Farina et al. | 52/235 |
| 4,649,688 | A | * | 3/1987 | Mosier | 52/644 |
| 4,882,883 | A | | 11/1989 | Horn | |
| 5,402,608 | A | | 4/1995 | Chu | |
| 6,463,705 | B1 | | 10/2002 | Davis | |
| 2005/0066589 | A1 | | 3/2005 | Bedell | |
| 2005/0210762 | A1 | | 9/2005 | Broberg | |
| 2008/0134589 | A1 | | 6/2008 | Abrams | |

FOREIGN PATENT DOCUMENTS

| | | | | |
|---|---|---|---|---|
| JP | 08074317 | A | * | 3/1996 |
| JP | 10046661 | A | * | 2/1998 |
| JP | 11303209 | A | * | 11/1999 |
| JP | 2002030726 | A | * | 1/2002 |
| JP | 2008223358 | A | * | 9/2008 |

* cited by examiner

*Primary Examiner* — Jeanette E. Chapman
(74) *Attorney, Agent, or Firm* — Mark J. Nahnsen; Barnes & Thornburg LLP

(57) ABSTRACT

The present disclosure relates to a box-shaped structure of inter-related structural components. The structural components are combined to create a single three dimensional component the shape of a rectangular prism. The structure is formed by creating a pair of exterior walls from horizontal members and a series of laterally spaced vertical members that are coupled to the horizontal members by truss plates. The structure also includes a series of laterally spaced rectangular ribs that are coupled to the exterior walls by additional truss plates. The ribs and the walls are further coupled by use of wood sheeting along the top of the structure to form the resultant assembly. The entire assembly is connected together with a series of bolt and steel angle connectors, allowing the entire module to act monolithically.

21 Claims, 20 Drawing Sheets

WIND FORCE RESISTANT STRUCTURE

CROSS-REFERENCE TO RELATED PATENT APPLICATIONS

This application claims priority to U.S. Provisional Application Ser. No. 61/103,011 that was filed on Oct. 6, 2008 and is incorporated in its entirety by reference herein.

FIELD OF THE INVENTION

The field of the invention lies within residential housing in the field of architecture and engineering. The final product is a modular unit; one which can stand alone or be combined with other modules to create larger units. The living units can "float" across a landscape, enabling minimal disturbance of flora and fauna, or traverse a stream, creating a bridge. Modular units are delivered—with design consideration given to highway transport—to a specific site, or transportable as a mobile unit to a specific site. The modules are designed to sit on supports at their final destination. The housing units of this type are built of lightweight wood frame construction, easily fitted into mobile housing markets. They are also built using the conventional existing industrial technology of fabrication and carpentry.

BACKGROUND

Housing has evolved throughout the ages, with modifications arriving in concurrence with culture, artistry and necessity. The current state of housing in this country is an affordable dwelling unit built with indigenous materials. Far from the stone structures of aristocracy, the majority of homes, even the expensive ones, utilize generally a wood veneer frame supported on a concrete foundation and/or steel or wood girder beams. More expensive homes may feature a brick exterior, but this is usually a decorative veneer. Most have a wood, vinyl or aluminum cladding over the wood "rough" or main structural framing. The wooden rough framing is fastened together with either nails or screws.

Homes are also built with metal framing, with a 12 to 24 gage metal, bent to mimic the cross-section of a milled wood unit, stud framing.

When this stud framing is used, the construction consists usually of either a 2×4 or 2×6 wooden stud with a cross sectional dimension of 1½"×3½" or 1½"×5½", respectively, at a distance of 16" or 24" on center. This is built over a plate, which sits on a floor deck generally consisting of 2×8, 2×10 or 2×12 dimensional milled lumber. New technology may feature different elements, such as floor trusses or composite beams and joists of various configurations, but the building components generally act in similar structural fashion.

The method of concrete footing over undisturbed soil, excavated to a point at which frost cannot cause upheaval of the ground, with a concrete foundation above it, a sill plate bolted into the concrete, a floor deck over the sill, walls over the floor deck, another floor deck or roof above, and roof rafters to complete the roof, is known as Platform Framing. The standard method for the construction of homes in this country.

When solid masonry is used in lieu of wood framing, the overall method is roughly similar. The wall, for example, in a two story structure, goes from the concrete foundation wall to the roof, and floor joists are framed within the wall, usually "fire cut," or with an angle which, in a fire, can allow the floor to drop down without toppling the wall.

In a mobile home, the construction is usually somewhat identical to a wood frame home, with consideration given to the dynamic loads due to transportation. Modular homes, by their nature, are usually fabricated in a factory, but the notion that the dwelling unit is "modular" does not necessarily mean that there is an inherent additional strength in the structure.

The problem with all of these methods of construction lies in their inherent compartmentalization of components and their inability to interact with each other. When a force is applied to one element of the building, the only awareness of this force sensed by other components may be in the movement of these components once the structure starts to fail. This failure can be as a result of one component pushing against another as a result of a wind load, but the other piece cannot "feel" the force on its preceding component and thus provide any assistance to it. Also, components are fastened in a way as to resist gravity loads, but allow little or no protection against the torsional, lateral or other severe forces as a result of a cataclysmic wind event.

Also, the custom nature of domestic housing creates a cost factor that would be eliminated in a modular house, with the structural strength built into the design, and not required to have structural rigidity added at extra cost. In addition, the modular design results in more controlled costs due to the standardization of framing elements.

SUMMARY

The present disclosure is directed to a modular housing unit that comprises of a series of components, which allow the entire unit to act monolithically, and allow the farthest part of the structure to "sense" and react to a force on the other side of the building. Thus, the unit acts as a single piece; not having the consequences of homes one observes after a tornado, with lumber and other building parts lying about the landscape like a pile of toothpicks.

According to the present disclosure, a modular building unit is made of a series of spaced apart ribs designed to resist moment forces at each corner. The ribs are spaced at a specific distance apart to enable each rib to sufficiently withstand the designed wind load. The ribs are attached via metal connectors and bolted to a pair of Vierendeel truss structures at the sides and plates consisting of supported plywood sheathing at the top and bottom.

According to the present disclosure, the ribs and Vierendeel trusses consist of lumber fastened together via truss plates and/or metal connectors to create the resultant component shapes. The model used for the illustrations in the description is a unit 11'-0" high×13'-10" wide×50'-0" long, with the ribs at 5'-0" on center. The lumber used is standard building grade 2×12 lumber and the connectors are as shown in the figures referenced in the description. Larger dimensions of the modular unit may result in larger components, lumber and connectors in calculated proportion to the size of the module.

The present disclosure provides a relatively large and open housing module that can resist the forces exerted by tornadoes up to an EF5. The structure is lightweight, inexpensive, able to be transported, used singularly or in multiples, and supported by a minimum of four points; allowing the structure to be put in areas with minimal impact to landscape or across land depressions or water elements.

The modular unit is projected to be constructed by truss component manufacturers, steel fabricators and carpenters, thus utilizing the current existing marketplace.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIGS. 9 and 16 (left side of FIG. 9 only) are elevations of the connection of the rib to the Vierendeel truss for Alt. 2;

DETAILED DESCRIPTION

The present disclosure relates to a box-shaped modular building structure of inter-related structural components. These individual components combine to create a single three dimensional component the shape of a cuboid, or rectangular prism. The cuboid is a box, which houses a living unit designed to be impervious to high wind forces. These forces are imposed on the building's Main Wind Force Resisting System (MWFRS).

The MWFRS is designed as a modular building structure to withstand a calculated wind force in three dimensions, which, in this design, has been calculated to an equivalent force of an EF5 tornado, or Category Five hurricane. The main "pieces" of this final component are the Vierendeel trusses, which are the main longitudinal walls of the building. The vierendeel truss is a truss where the members are not triangulated but form rectangular openings, and is a frame with fixed joints that are capable of transferring and resisting bending moments. Regular trusses comprise members that are commonly assumed to have pinned joints with the implication that no moments exist at the jointed ends. The concept of the Vierendeel truss is the modification of a standard rectangular truss with higher moment connections to allow the omission of diagonal webs. This arrangement allows windows and doors to be placed in the walls without diagonal structural restrictions.

Onto the walls, ribs 15 are fastened, which are moment-resistant members that are spaced evenly throughout the length of the modular housing unit. This resists lateral torsion evenly throughout the length of the structure. The top and bottom of the structure are multiple layers of plywood 101, which allow diaphragm lateral resistance similar to the Vierendeel truss, but without any necessary openings, as these are the main elements of the floor and roof of the housing module. The entire assembly is connected together with a series of bolt and steel angle connectors 20, 24; allowing the entire module to act monolithically. Every force utilizes the adjacent member to enable corresponding member to resist forces. This is an economy in structural design because the need for large beams is eliminated. Instead of using a large beam, the adjacent member resists the force.

Figure 1:
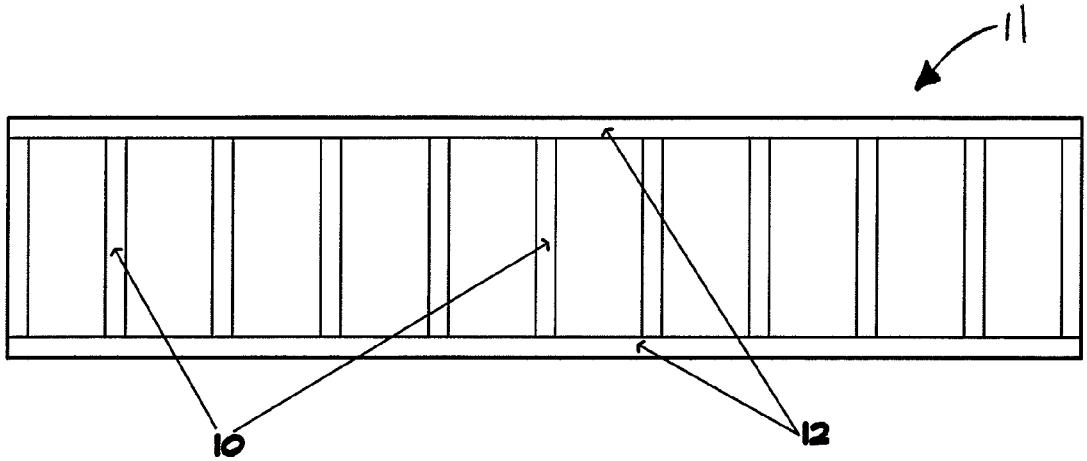

FIG. 1 of the present disclosure shows the configuration of the Vierendeel truss 11, which is the longitudinal side wall of the module. The large voids shown on the drawing are open spaces, with the narrower parallel lines shown is standard building grade 2×12 lumber. This embodiment is used with the intention for a module size that can be highway transported, with a width of 13'-10" (The allowable width on a highway for a transported home is 14'-0". The 13'-10" dimension allows for an additional 1" of outer sheathing.) The other intended dimensions for this embodiment is a length of 50'-0", a height of 11'-0" and grid center line dimensions of 5'-0" Larger or smaller modules may result in larger components, lumber and connectors in calculated proportion to the size of this embodiment.

The nature of the Vierendeel truss is to allow for the openings to allow for passage for doors to the exterior of the module or passage between modules in multiple module arrangements, and for windows along the entire perimeter of the unit. The Vierendeel truss enables, thus, an openness of light, ventilation and passage while still maintaining total structural integrity for gravity, lateral and seismic loads. The vertical 2×12 member (element 10) is shown, as is the horizontal member of the Vierendeel truss (element 12).

Figure 2:
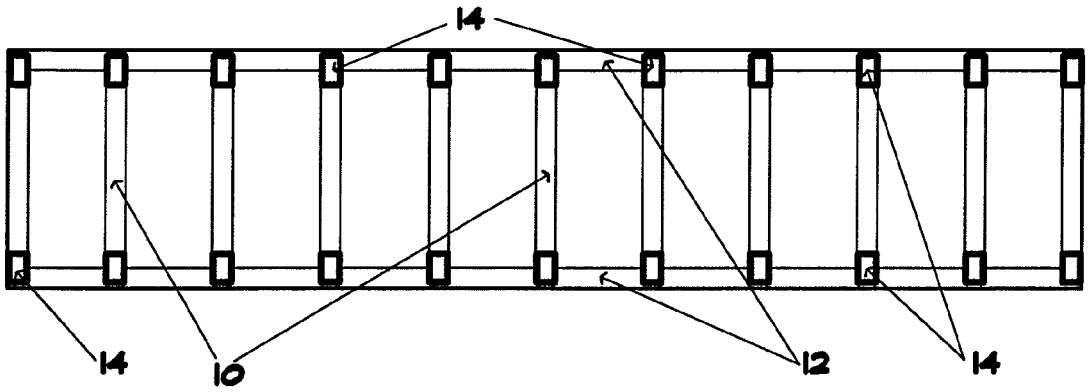
FIGS. 1 and 2 are elevations of the Vierendeel truss component.

FIG. 2 shows the Vierendeel truss 11 with truss plates 14 attached to the intersection of wood elements 10, 12. The Vierendeel truss has, by virtue of the elimination of diagonal webs, high moment forces at each junction of vertical and horizontal wood elements. The truss plate connectors (element 14) are designed to withstand the moment forces exerted at each connection point. Fortunately, the forces, by virtue of the length and height of the Vierendeel truss in relation to the forces involved, are relatively small. Thus, a double ply Vierendeel truss on each side with truss plates 14 is sufficient to withstand the forces exerted by an EF5 tornado. (The EF5 is the highest level of force exerted among the cataclysmic events of EF5 tornado, Category Five hurricane and, due to the use of light frame construction where wind is critical, a Seismic event of any magnitude. Thus, this is the event used in this application.)

Figure 3:
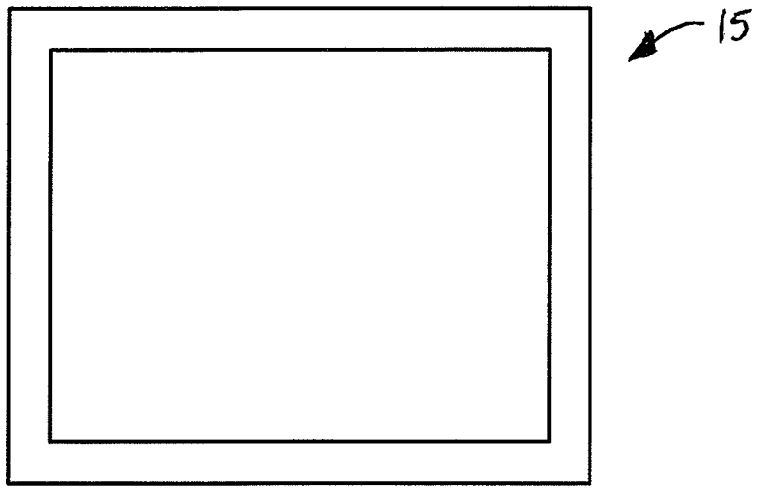
FIG. 3 is an elevation of the rib component profile.

FIG. 3 shows the configuration of the rib 15, which is the other primary structural element of this embodiment. The large void shown is the open space which will comprise of the interior of the unit. The horizontal and vertical boards 16, 18 shown are standard building grade 2×12 lumber. As indicated in the above discussion, larger or smaller dimensions of the modular unit results in larger components, lumber and connectors in calculated proportion to the size of the module.

Figure 4:
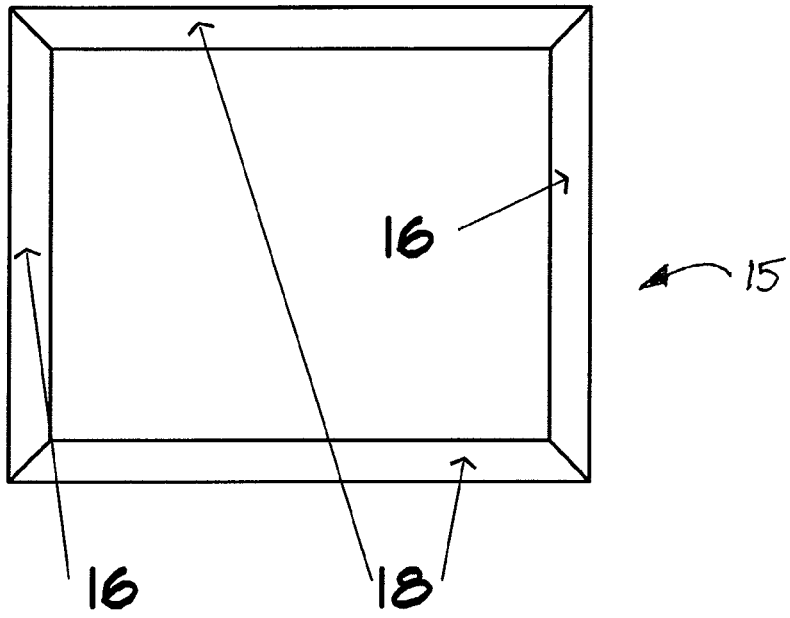
FIG. 4 is an elevation of the rib with the individual elements of the ribs illustrated in the steel angle plate alternative (Alt 1)

FIG. 4 shows the rib 15 with the individual lumber elements of the ribs as used in the steel angle plate alternative (Alt. 1). Alt. 1 is the first calculated rib using a hot rolled steel plate connector plate (element 20, not shown in this figure). In this alternative, all of the forces created to provide racking of the rib 15 are counteracted by the steel angle itself. This allows for easiest calculation. The forces at the corners of the ribs 15 which are caused by an EF5 tornado are extreme and require major elements which would not be satisfied by truss plate connectors in a single or double ply configuration. The vertical 2×12 member (element 16) is shown, as is the horizontal member of the rib 15 (element 18).

Figure 5:
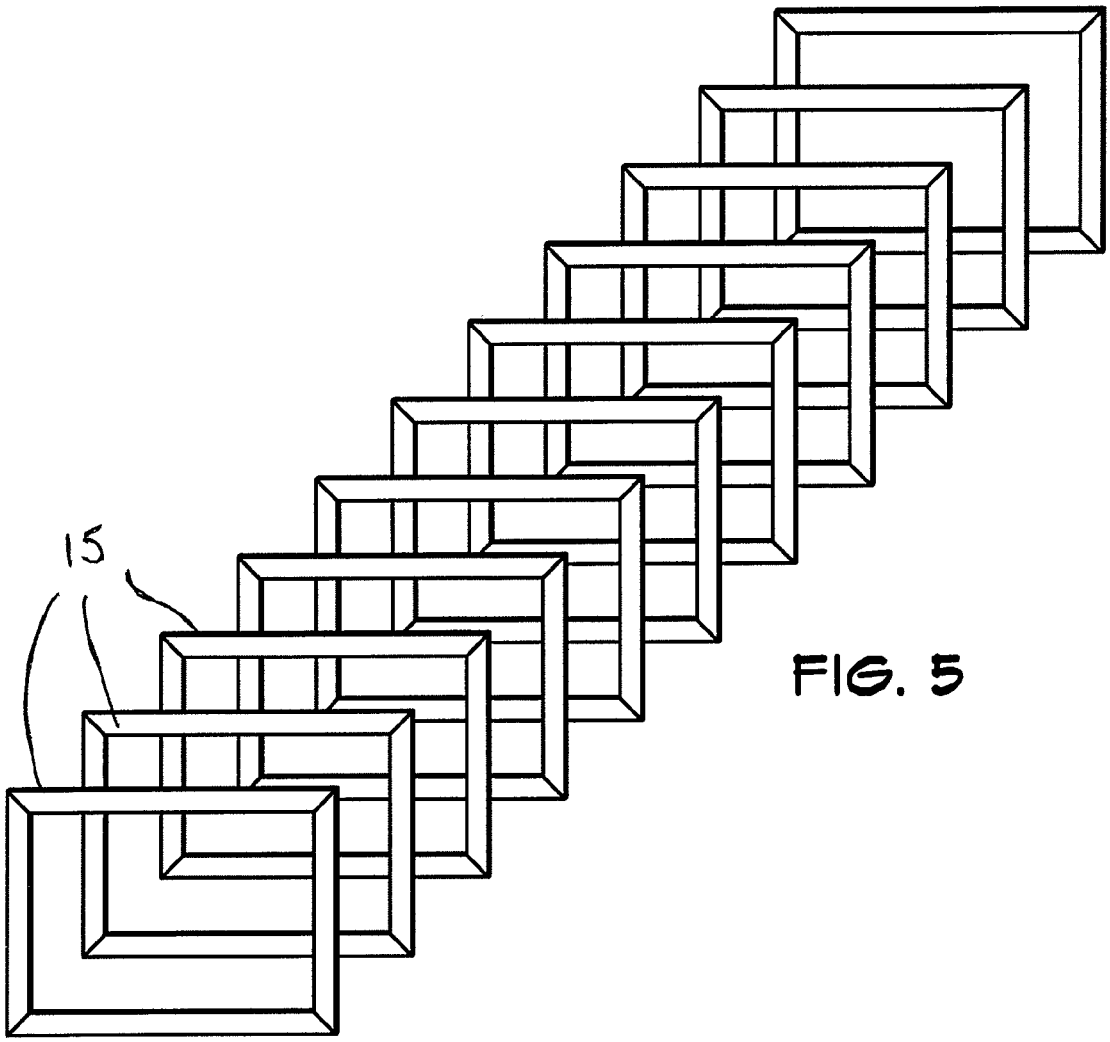
FIG. 5 shows the ribs in the arrangement existing in the module.
Figure 6:
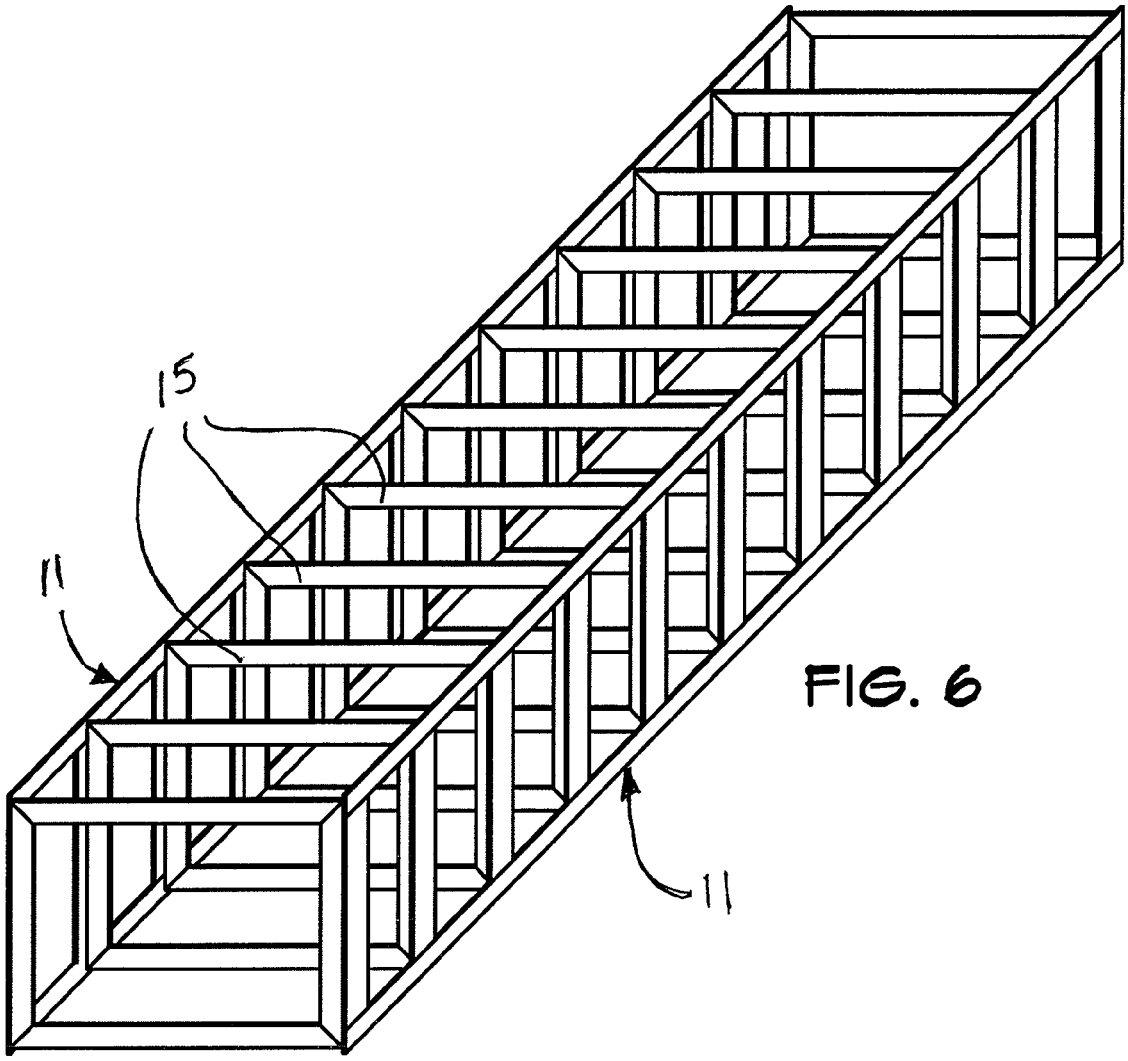
FIG. 6 shows the same ribs with the inclusion of the Vierendeel truss.

FIG. 5 is an isometric drawing showing the configuration of the ribs 15 as they will exist in the module. This drawing, as well as the isometric drawing in FIG. 6, can be used for illustration for both alternative 1 and alternative 2 for rib connections. FIG. 6 is an isometric drawing showing the configuration of the ribs 15 as they will exist in the module with the inclusion of the Vierendeel truss 11, also in its configuration as it will exist in the module.

Figure 7:
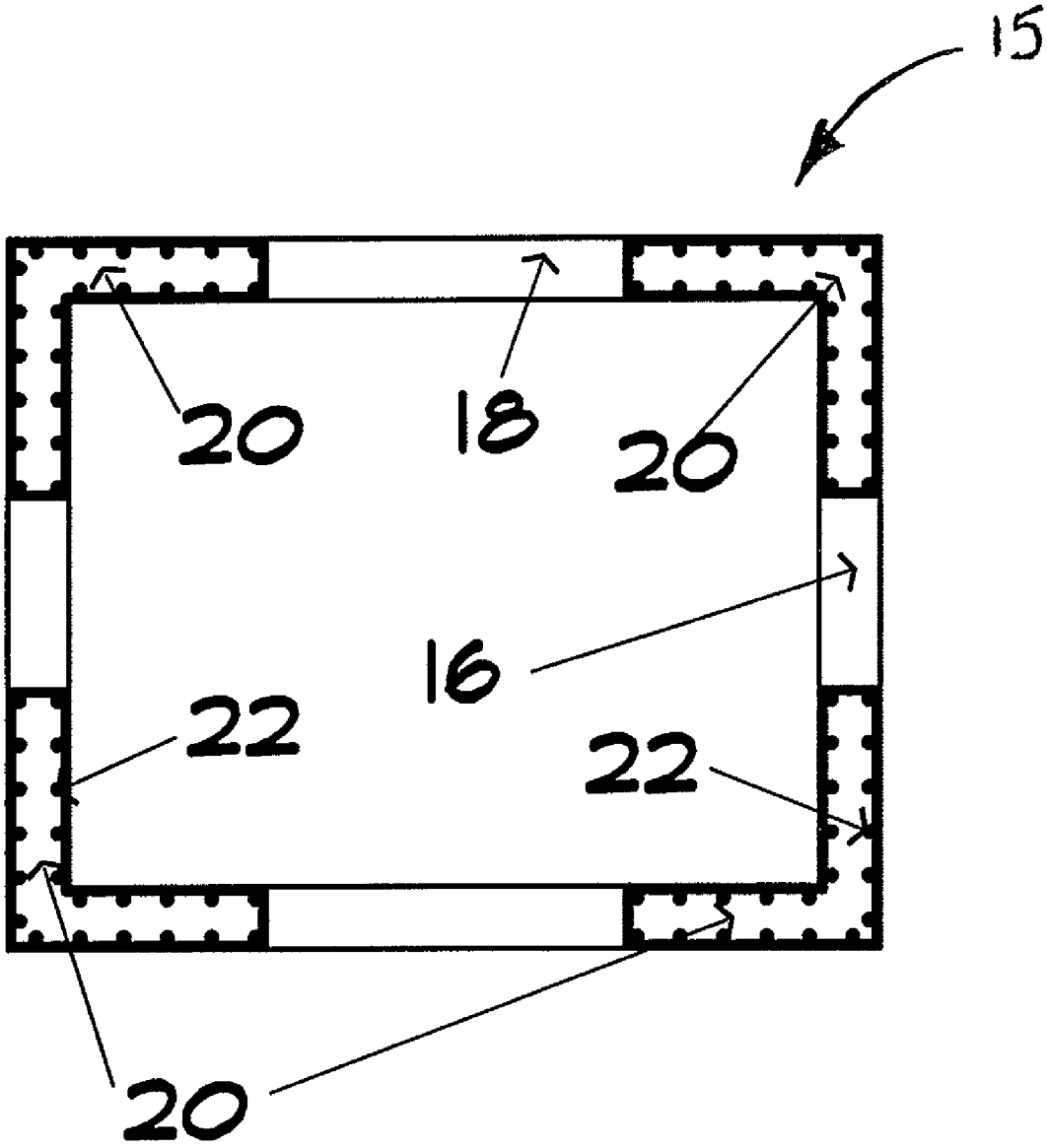
FIGS. 7 and 8 are elevations of the rib highlighting the steel corner brace of Alt. 1.

FIG. 7 shows the rib 15 for alternative 1 with the inclusion of the steel plate 20 used in the corners. The steel plate is a 10" wide×45" long each direction×¼" thickness minimum 36K metal corner brace (element 20). Brace must be entirely embedded on solid wood and should not extend past the edge of the lumber. One plate shall exist on each side of 2×12 lumber at each corner, giving a total of 8 steel plate connectors 20 per each rib assembly 15. Plates to be fastened to each other on opposite side of rib via 22 total minimum ¾" bolts (element 22). Braces to receive 1" holes.

Figure 8:
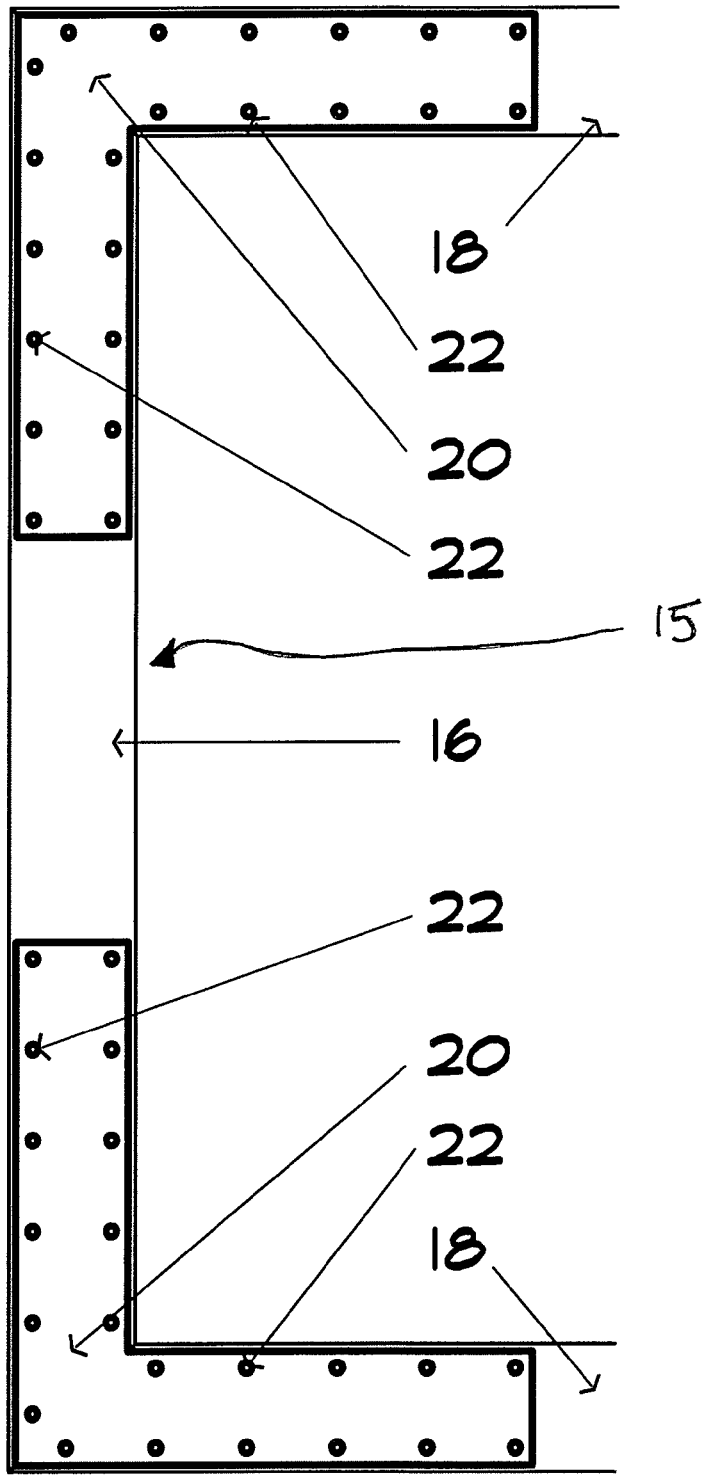
Figure 9:
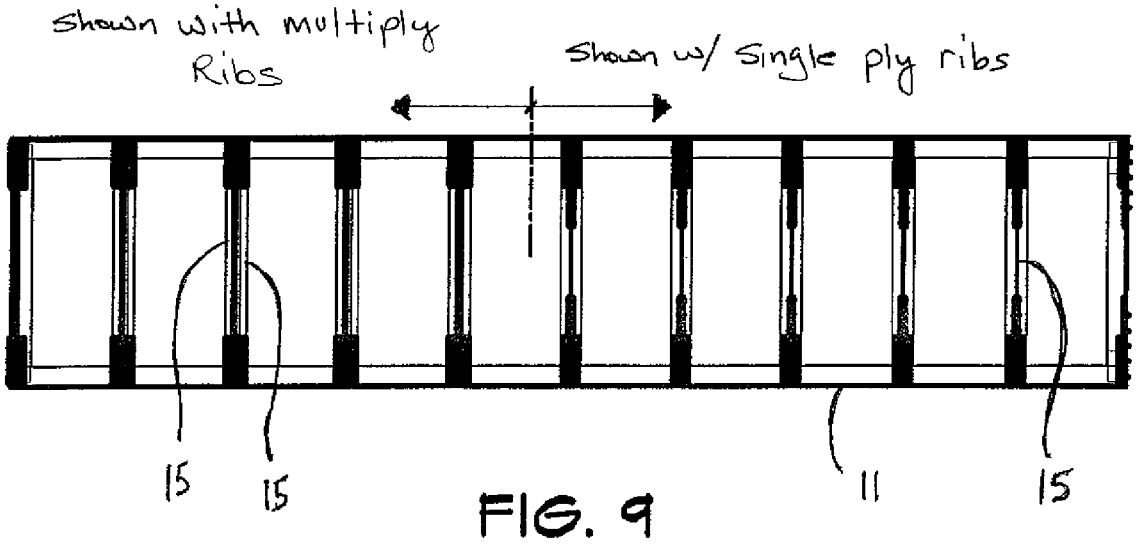
FIGS. 9 and 10 (right side of FIG. 9 only) are elevations of the connection of the rib to the Vierendeel truss for Alt. 1.

FIG. 8 is a close-up view of two of the corners of a rib 15 showing the steel plate 20 at the corners. FIG. 9 shows the ribs connected to the Vierendeel truss. On the right side of this drawing, the connections for Alt. 1 are shown. On the left side of the drawing, the connections for Alt. 2 are shown.

Figure 10:
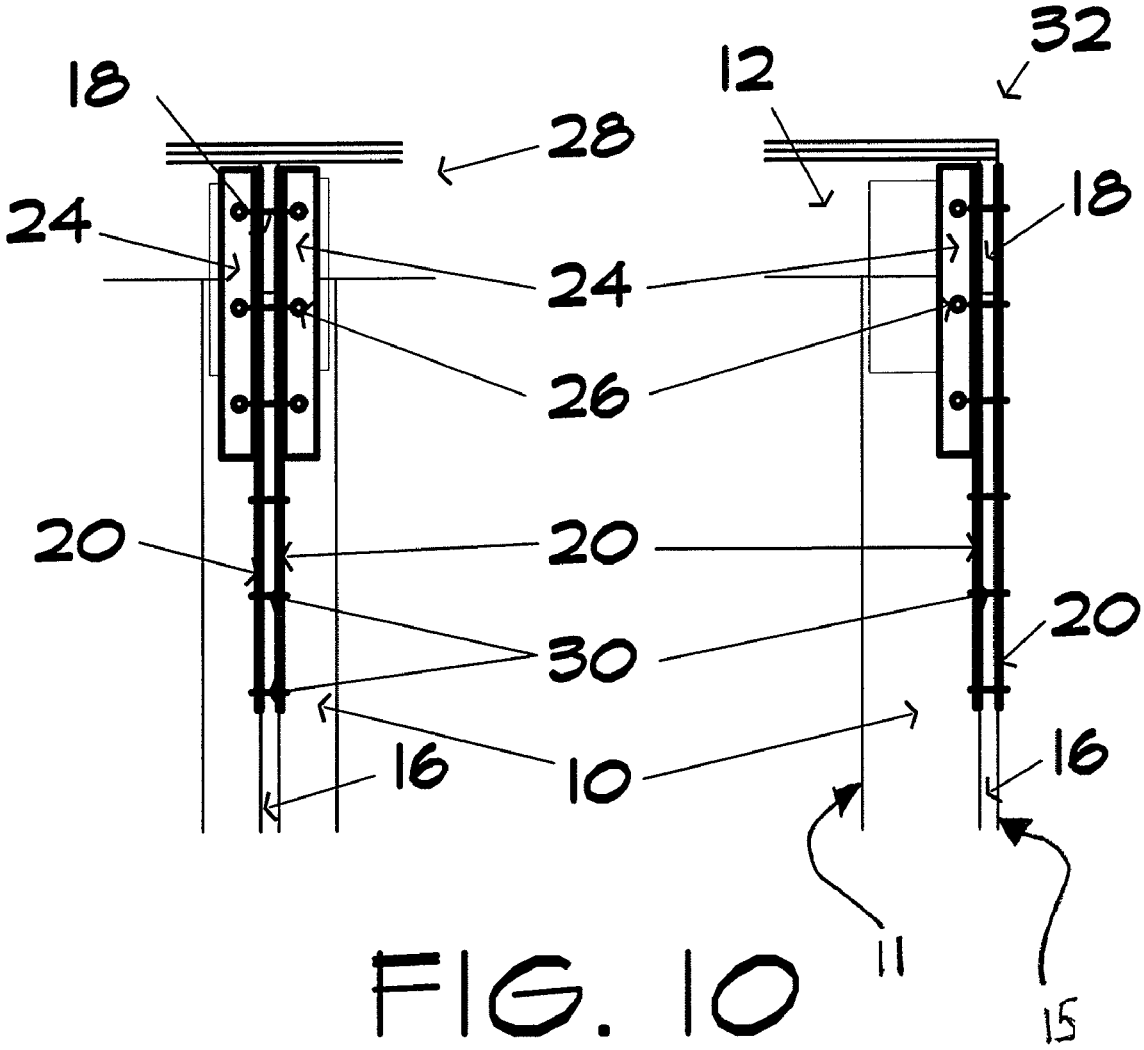

FIG. 10 shows close-up of the rib connection to the Vierendeel truss 11 highlighting two conditions: the connection at the end of the truss and a typical connection at each vertical member of the Vierendeel truss 11. At the typical connection, a 3"×4"×¼"×24" long steel angle (element 24) is fastened through the Vierendeel truss 11 with ¾" diameter×2½" long through-bolts at 8" on center (element 26) with 1" holes. A 10½"×24"×¼" thick steel plate (element 28—opposite side of 2×12 member, not shown) is centered on the outside of the truss 11 to receive the bolts.

The 3"×4"×14"×24" long steel angle (element 24) is fastened to a similar 3"×4"×14"×24" long steel angle (element 24), first going through a 10" wide×45" long each direction×¼" thickness minimum 36K metal corner brace (element 20), the 2×12 members of the rib (elements 16 and 18), a 10" wide×45" long each direction×¼" thickness minimum 36K metal corner brace (element 20) on the other side of the 2×12 member, and finally through the other 3"×4"×14"×24" long steel angle (element 24) fastening with ¾" diameter×6" long through-bolts (element 30). 1" holes are used at all bolt points.

The holes in the 3"×4"×¼"×24" long steel angles mimic the holes on the metal 10" wide×45" long each direction×¼" thickness corner brace. At the end condition, the 3"×4"×14"×24" long steel angle (element 24) is fastened through a 10" wide×45" long each direction×¼" thickness minimum 36K metal corner brace (element 20) through the 2×12 members of the rib (elements 16 and 18), and finally through another 10" wide×45" long each direction×¼" thickness minimum 36K metal corner brace (element 20).

Figure 11:
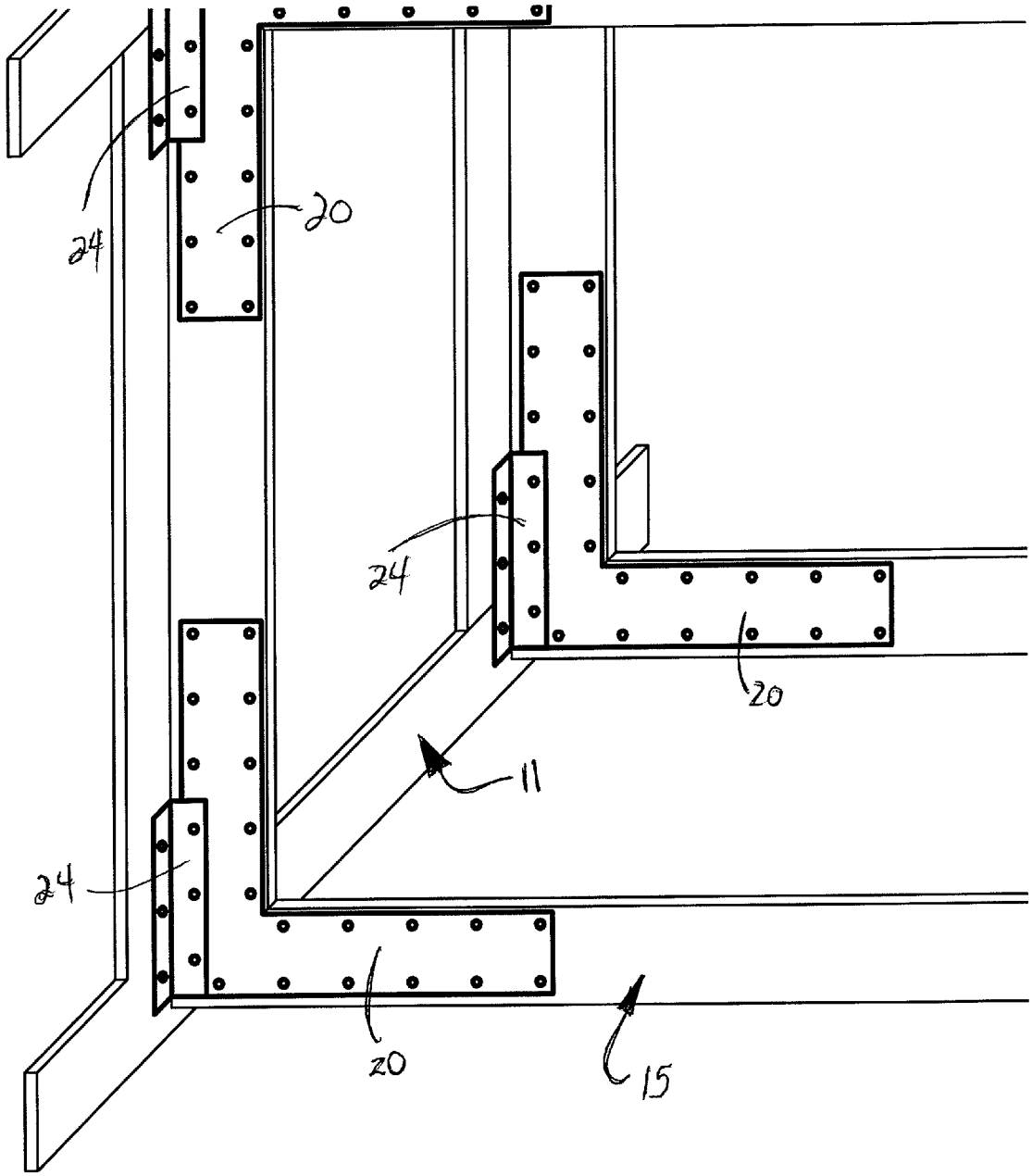
FIG. 11 is an isometric drawing showing the connection of the rib to the Vierendeel truss for Alt. 1.

At the end condition through the Vierendeel truss 11, the 3"×4"×14"×24" long steel angle (element 24) is fastened through the 2×12 members of the truss (elements 10 and 12) and finally through a 4"×24"×¼" thick end plate (element 32—opposite side of 2×12 member, not shown) fastening with ¾" diameter×2½" long through-bolts (element 26). 1" holes are used at all bolt points. The holes in the 3"×4"×¼"×24" long steel angles mimic the holes on the metal 10" wide×45" long each direction×¼" thickness corner brace and the 4"×24"×¼" thick end plate. FIG. 11 shows an isometric drawing which greater explains the connection condition at the interim vertical connections of the Vierendeel truss as described above.

Figure 12:
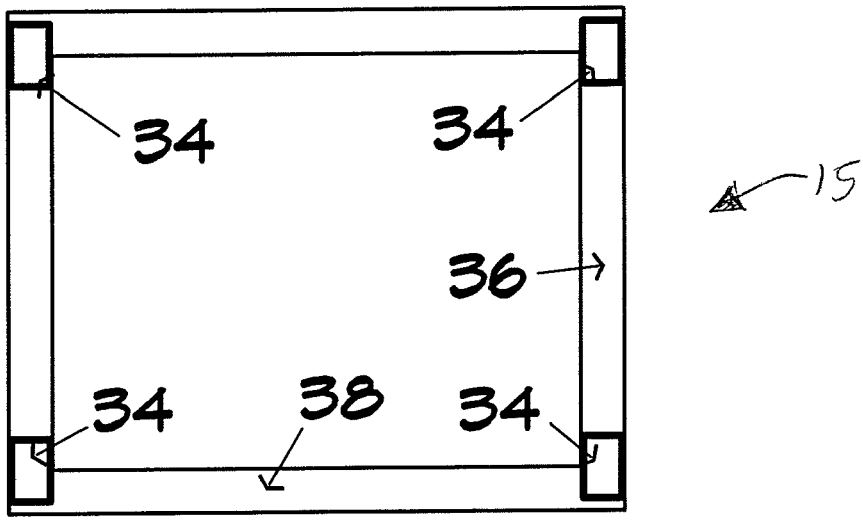
FIGS. 12 and 13 are elevations of the rib showing two individual elements of the ribs illustrated in the multi-ply rib with truss plate alternative (Alt. 2)

FIG. 12 shows the first ply of a multiple ply rib 15 condition as utilized in the multi-ply rib 15 with truss plate alternative (Alt. 2). Alternative 2 is designed to be a less expensive alternative to the metal angle corner brace (element 20). In Alt 2, testing will determine the amount of plies required using a maximum sized truss plate connector on each side of each corner.

Differing from the wood mitered corners of Alt. 1 using elements 16 and 18, Alt. 2 uses straight corners as shown and minimum 10"×16" minimum 20 gage metal plate connectors (element 34) on each side of the 2×12 wood members at the corners. The minimum 10"×16" minimum 20 gage metal plate connector (element 34) must be centered on the straight joint and be entirely embedded on solid wood and not extend past any edges of the lumber. The actual size of element 34 may be less than 10"×16", but that size will be determined by the truss fabricator. The plates are to be installed on both sides of the vertical 2×12 member (element 36) and the horizontal 2×12 member (element 38) of the rib directly opposite of each other. Each rib 15 of each ply to receive a total of (8) plates ((2) on each side of (4) corners).

Figure 13:
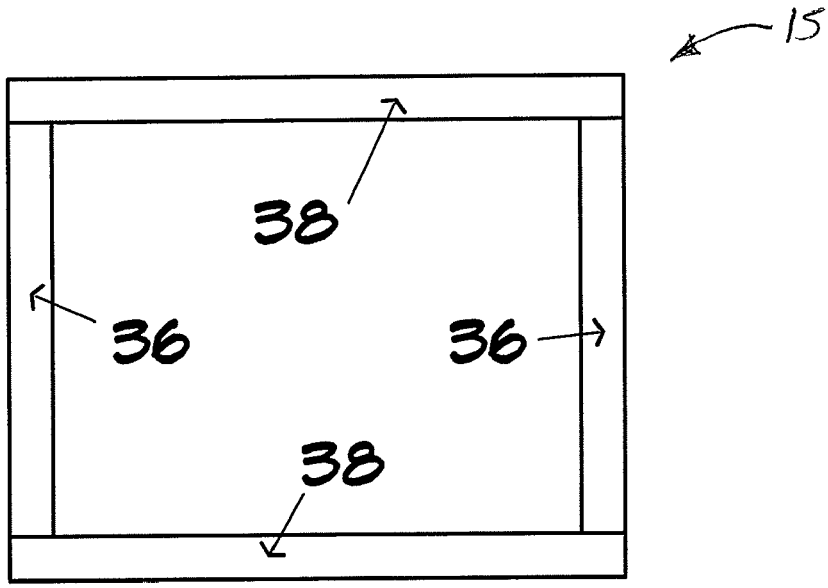
Figure 14:
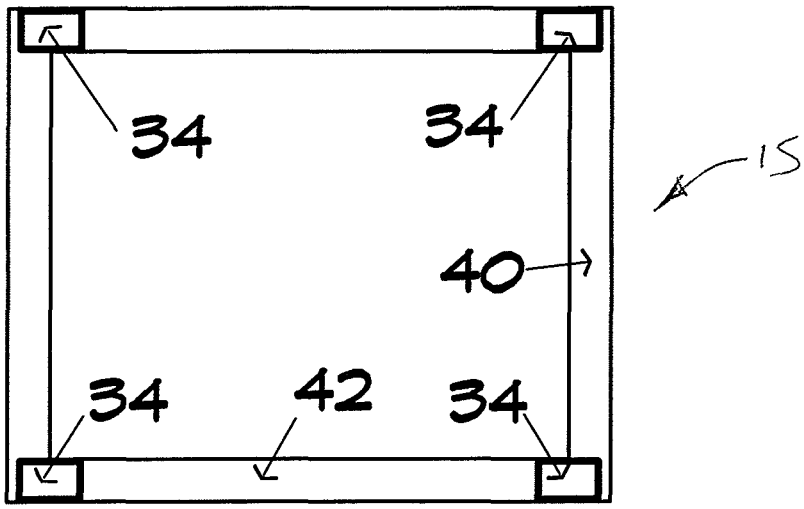
FIGS. 14 and 15 are elevations of the two individual elements highlighting the truss plates used on alternate plies for Alt.2.

FIG. 13 shows the configuration of the vertical 2×12 members (element 36) and the horizontal 2×12 members (element 38) on the first ply. FIG. 14 shows the alternate ply of the multiple ply rib condition of Alt. 2. Rib 15 also has straight corners as shown and minimum 10"×16" minimum 20 gage metal plate connectors (element 34) on each side of the 2×12 wood members at the corners. The minimum 10"×16" minimum 20 gage metal plate connector (element 34) must be centered on the straight joint and be entirely embedded on solid wood and not extend past any edges of the lumber. The actual size of element 34 may be less than 10"×16", but that size will be determined by the truss fabricator. The plates are to be installed on both sides of the vertical 2×12 member (element 40) and the horizontal 2×12 member (element 42) of the rib directly opposite of each other. Each rib of each ply to receive a total of (8) plates ((2) on each side of (4) corners).

Figure 15:
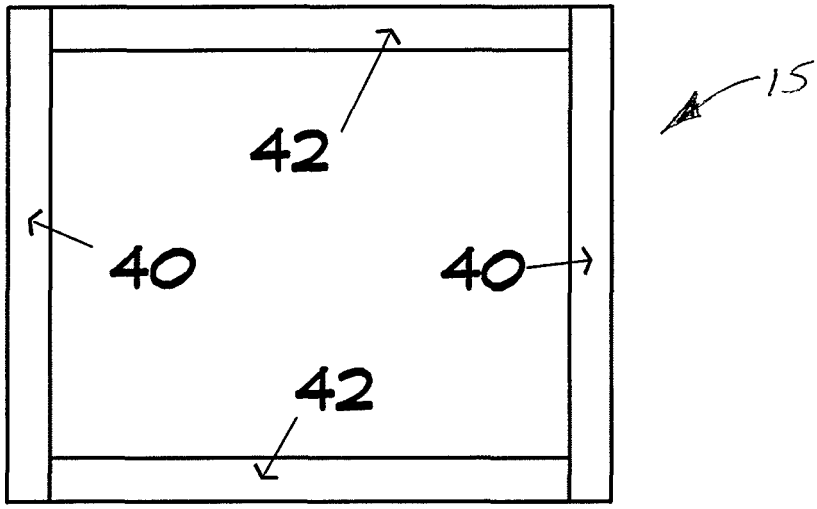

FIG. 15 shows the configuration of the vertical 2×12 members (element 40) and the horizontal 2×12 members (element 42) on the alternate ply. The first ply (and subsequent odd numbered plies—the total amount of plies as determined by testing) and the alternate plies feature staggered joints for the connection points to maintain structural rigidity of multiple plies. Having all of the joints of the multiple plies at the same location would cause a weak condition.

Figure 16:
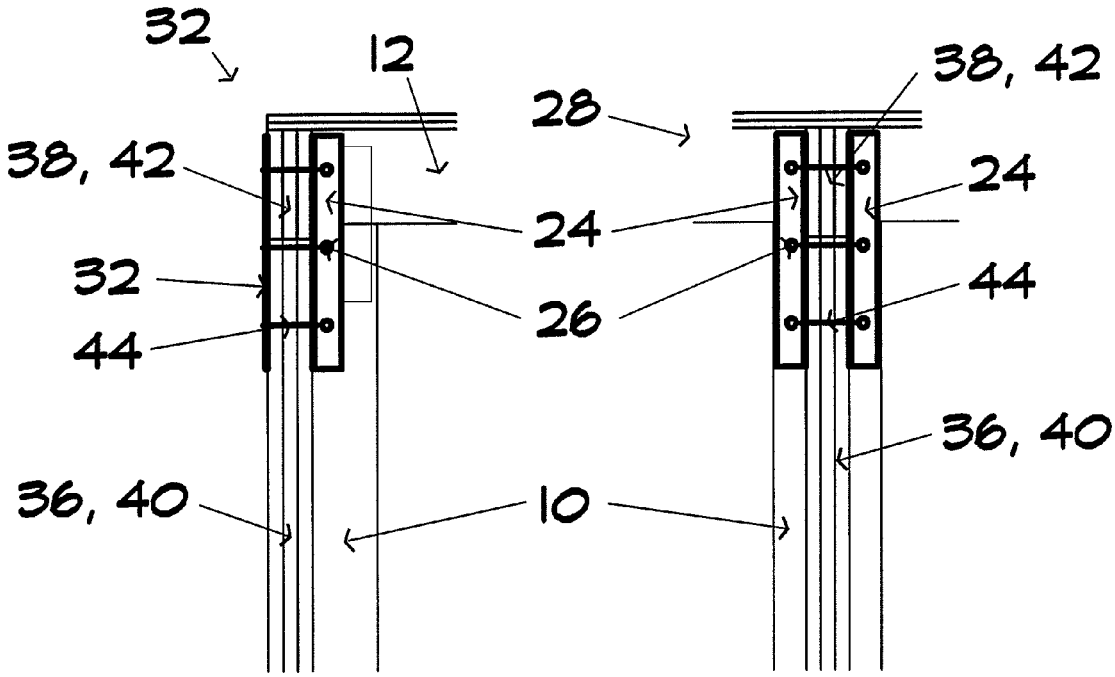

FIG. 16 shows a close-up of the rib connection to the Vierendeel truss 11 for Alt. 2 highlighting two conditions: the connection at the end of the truss and a typical connection at each vertical member of the Vierendeel truss. At the typical connection, a 3"×4"×¼"×24" long steel angle (element 24) is fastened through the Vierendeel truss with ¾" diameter×2½" long through-bolts at 8" on center (element 26) with 1" holes. A 10½"×24"×¼" thick steel plate (element 28—opposite side of 2×12 member, not shown) is centered on the outside of the truss to receive the bolts.

The 3"×4"×14"×24" long steel angle (element 24) is fastened to a similar 3"×4"×14"×24" long steel angle (element 24), first going through the 2×12 members of the rib (elements 36, 38, 40 and 42), and finally through the other 3"×4"×14"×24" long steel angle (element 24) fastening with through-bolts measuring ¾" diameter and length to be determined by tested number of plies (element 44). 1" holes are used at all bolt points. The holes in the 3"×4"×¼"×24" long steel angles align. At the end condition, the 3"×4"×14"×24" long steel angle (element 24) is fastened through the 2×12 members of the rib (elements 36, 38, 40 and 42), and finally through a 4"×24"×¼" thick end plate (element 32) fastening with through-bolts measuring ¾" diameter and length to be determined by tested number of plies (element 44).).

At the end condition through the Vierendeel truss 11, the 3"×4"×14"×24" long steel angle (element 24) is fastened through the 2×12 members of the truss (elements 10 and 12) and finally through a 4"×24"×¼" thick end plate (element 32—opposite side of 2×12 member, not shown) fastening with ¾" diameter×2½" long through-bolts (element 26). 1" holes are used at all bolt points. The holes in the 3"×4"×¼"×24" long steel angles mimic the holes on the 4"×24"×¼" thick end plate.

Figure 17:
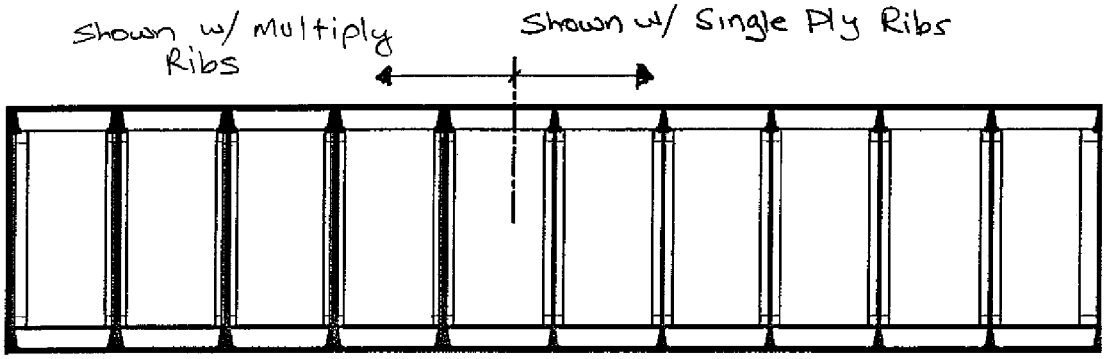
FIGS. 17, 18, 19 and 20 are elevations and sections of the rib and Vierendeel truss assembly with the inclusion of additional elements for floor and roof support (transverse assembly), flooring and roof sheathing.

FIG. 17 shows an elevation of the rib 15 and Vierendeel truss 11 assembly with the inclusion of additional elements for floor and roof support (transverse assembly), flooring and roof sheathing. This elevation shows the condition for single plies (Alt. 1) on the right side of the drawing and the condition for multiple plies (Alt. 2) on the left side of the drawing.

Figure 18:
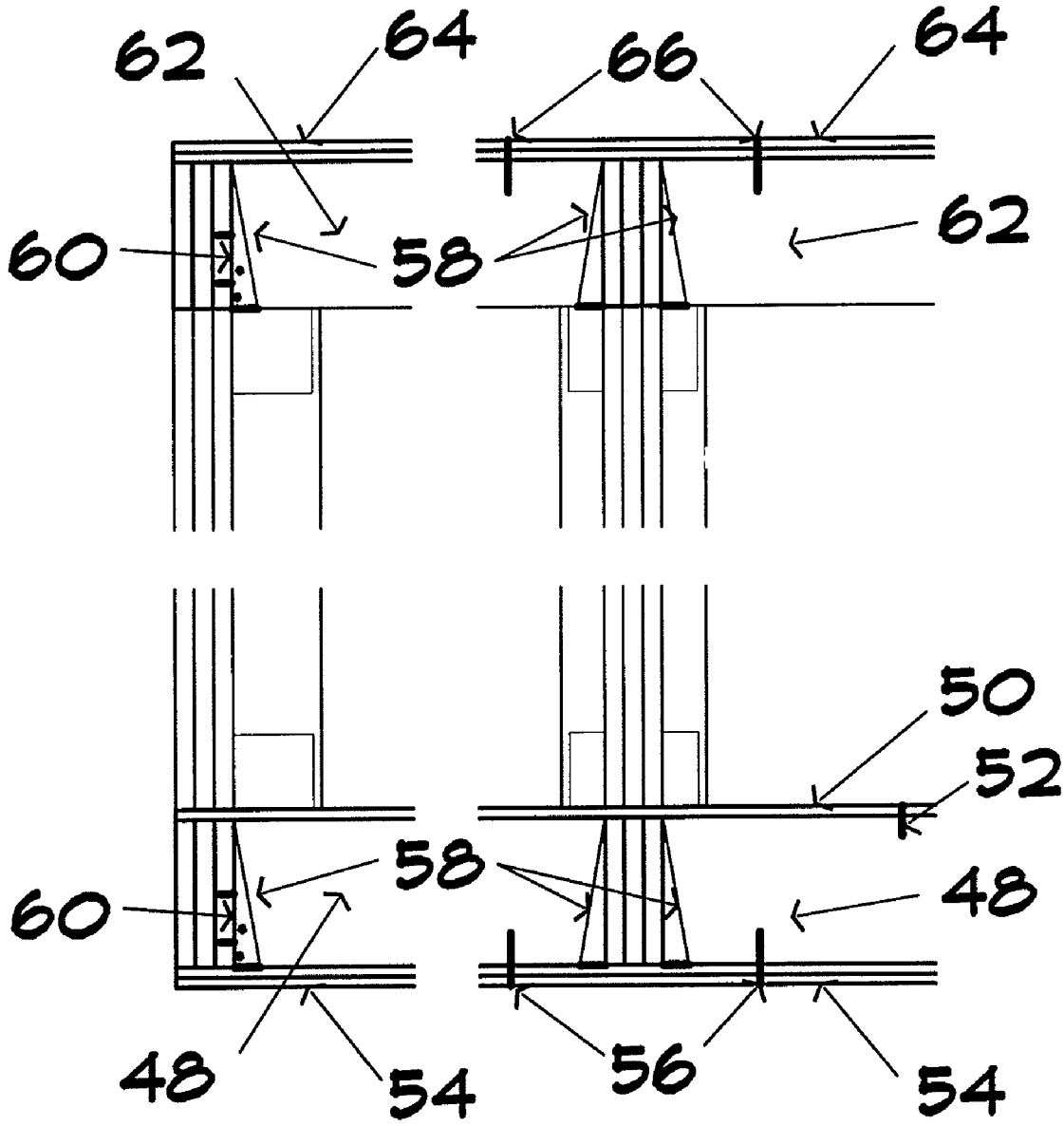

FIG. 18 shows a close-up of the rib 15 and Vierendeel truss 11 assembly with the inclusion of additional elements for floor and roof support (transverse assembly), flooring and roof sheathing for Alt. 1. The transverse assembly is the name given for 2×12 joists used at the top and bottom of the module. The 2×12 members at the bottom of the assembly (element 48) support the floor of the interior of the module and the diaphragm at the underside of the module. The floor of the module consists of a single layer of ¾" plywood or oriented strand board (OSB), installed in as large pieces as possible with a minimum of joints (element 50) fastened to the 2×12 bottom members (element 48) with 2½"×#8 screws (element 52) and glue to be determined. The underside diaphragm of the module consists of (2) layers of ¾" plywood or OSB, minimum 4'-0"×8'-0" with the long dimension running parallel to the length of the module and only one cut 4'-0" dimension allowed on the width and only two cut plywood at each 8'-0" dimension (element 54).

The plywood must be installed so that the two layers are staggered, having the joints of the top layer of plywood minimum 2'-0" from the joint of the bottom layer of plywood. The plywood is fastened to the 2×12 bottom members (element 48) and the bottom members of the ribs (elements 18 or 38 and 42) via 4" long×¼" screws (element 56) at 8" on center. The 2×12 members at the bottom of the module are fastened to the ribs using joist hangers (USP or Simpson) specifications which support a minimum downward force of 650 pounds per hanger and an uplift force of minimum 650 pounds per hanger (element 58). The hangers are fastened to both the transverse assembly (bottom joists) and the bottom horizontal members of the ribs using nails or screws per manufacturer specification to maintain uplift and downward forces as previously specified (element 60).

The 2×12 members at the top of the assembly (element 62) support the diaphragm (also functioning as the roof) at the topside of the module. The topside diaphragm of the module consists of (2) layers of ¾" plywood or OSB, minimum 4'-0"×8'-0" with the long dimension running parallel to the length of the module and only one cut 4'-0" dimension allowed on the width and only two cut plywood at each 8'-0" dimension (element 64). The plywood must be installed so that the two layers are staggered, having the joints of the top layer of plywood minimum 2'-0" from the joint of the bottom layer of plywood.

The plywood is fastened to the 2×12 top members (element 62) and the top members of the ribs (elements 18 or 38 and 42) via 4" long×¼" screws (element 66) at 8" on center. The 2×12 members at the top of the module are fastened to the ribs using joist hangers (USP or Simpson) specifications which support a minimum downward force of 650 pounds per hanger and an uplift force of minimum 650 pounds per hanger (element 58). The hangers are fastened to both the transverse assembly (top joists) and the top horizontal members of the ribs using nails or screws per manufacturer specification to maintain uplift and downward forces as previously specified (element 60).

Figure 19:
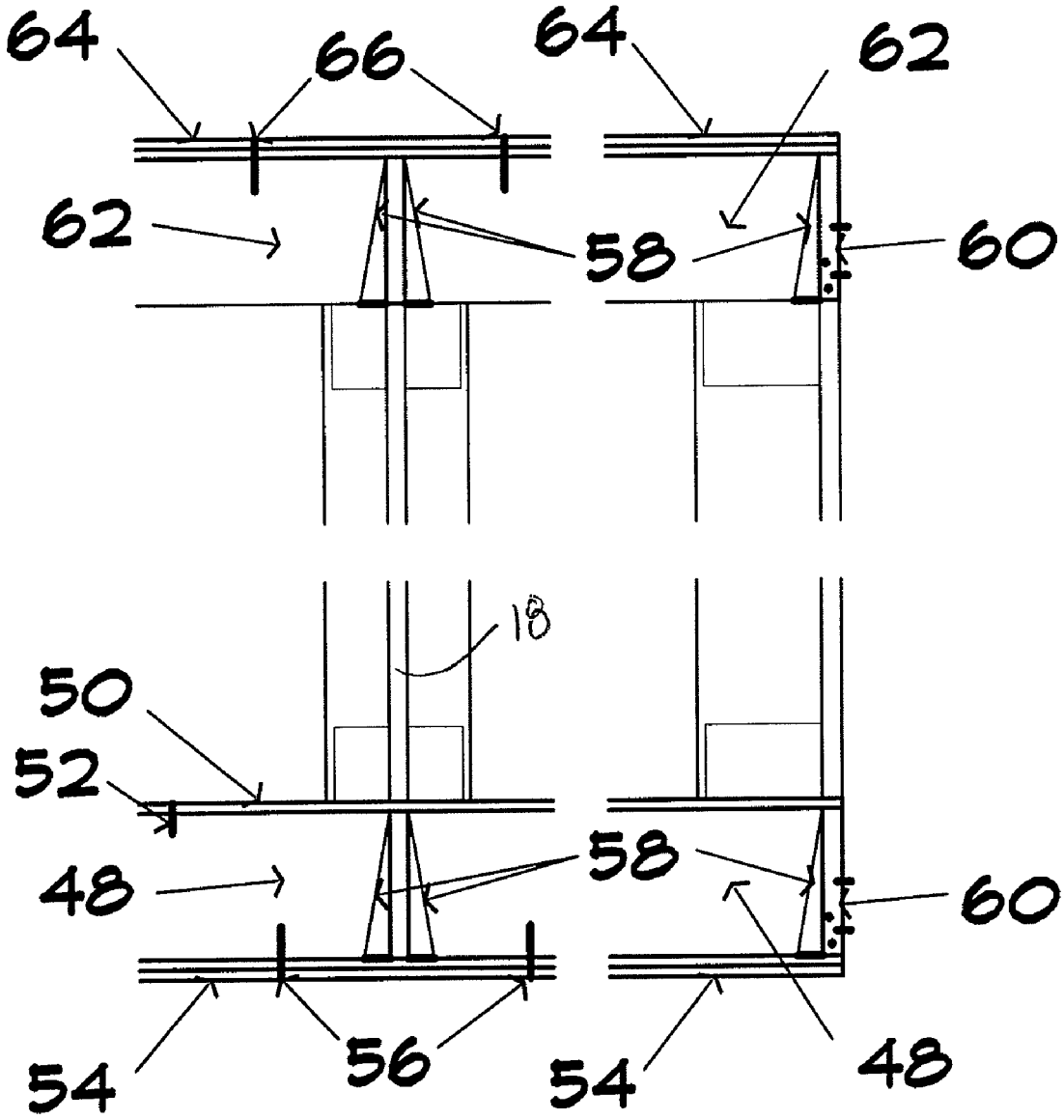

FIG. 19 shows a close-up of the rib 15 and Vierendeel truss 11 assembly with the inclusion of additional elements for floor and roof support (transverse assembly), flooring and roof sheathing for Alt. 2. The specifications for the multiple ply rib assembly (Alt. 1) is the same as that for the single ply assembly (Alt. 2): The 2×12 members at the bottom of the assembly (element 48) support the floor of the interior of the module and the diaphragm at the underside of the module. The floor of the module consists of a single layer of ¾" plywood or oriented strand board (OSB), installed in as large pieces as possible with a minimum of joints (element 50) fastened to the 2×12 bottom members (element 48) with 2½"×#8 screws (element 52) and glue to be determined.

The underside diaphragm of the module consists of (2) layers of ¾" plywood or OSB, minimum 4'-0"×8'-0" with the long dimension running parallel to the length of the module and only one cut 4'-0" dimension allowed on the width and only two cut plywood at each 8'-0" dimension (element 54). The plywood must be installed so that the two layers are staggered, having the joints of the top layer of plywood minimum 2'-0" from the joint of the bottom layer of plywood.

The plywood is fastened to the 2×12 bottom members (element 48) and the bottom members of the ribs (elements 18 or 38 and 42) via 4" long×¼" screws (element 56) at 8" on center. The 2×12 members at the bottom of the module are fastened to the ribs using joist hangers (USP or Simpson) specifications which support a minimum downward force of 650 pounds per hanger and an uplift force of minimum 650 pounds per hanger (element 58). The hangers are fastened to both the transverse assembly (bottom joists) and the bottom horizontal members of the ribs using nails or screws per manufacturer specification to maintain uplift and downward forces as previously specified (element 60).

The 2×12 members at the top of the assembly (element 62) support the diaphragm (also functioning as the roof) at the topside of the module. The topside diaphragm of the module consists of (2) layers of ¾" plywood or OSB, minimum 4'-0"×8'-0" with the long dimension running parallel to the length of the module and only one cut 4'-0" dimension allowed on the width and only two cut plywood at each 8'-0" dimension (element 64). The plywood must be installed so that the two layers are staggered, having the joints of the top layer of plywood minimum 2'-0" from the joint of the bottom layer of plywood.

The plywood is fastened to the 2×12 top members (element 62) and the top members of the ribs (elements 18 or 38 and 42) via 4" long×¼" screws (element 66) at 8" on center. The 2×12 members at the top of the module are fastened to the ribs using joist hangers (USP or Simpson) specifications which support a minimum downward force of 650 pounds per hanger and an uplift force of minimum 650 pounds per hanger (element 58). The hangers are fastened to both the transverse assembly (top joists) and the top horizontal members of the ribs using nails or screws per manufacturer specification to maintain uplift and downward forces as previously specified (element 60).

Figure 20:
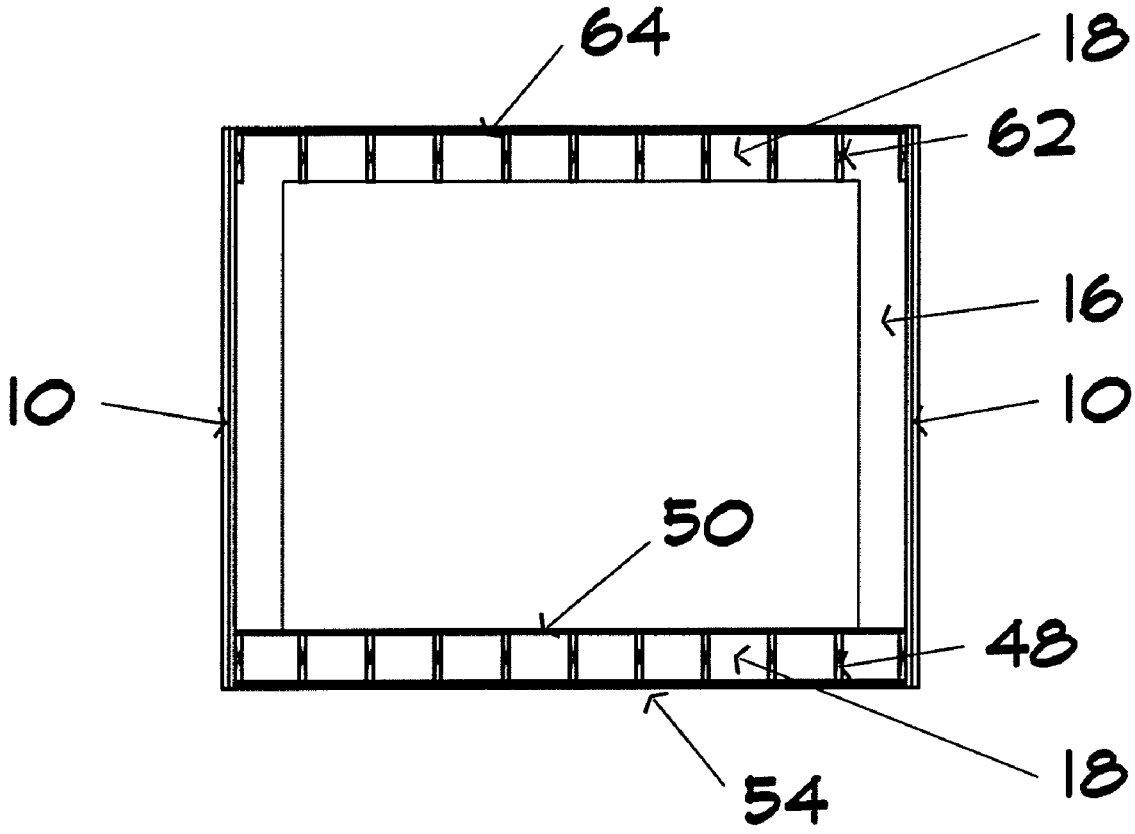
Figure 21:
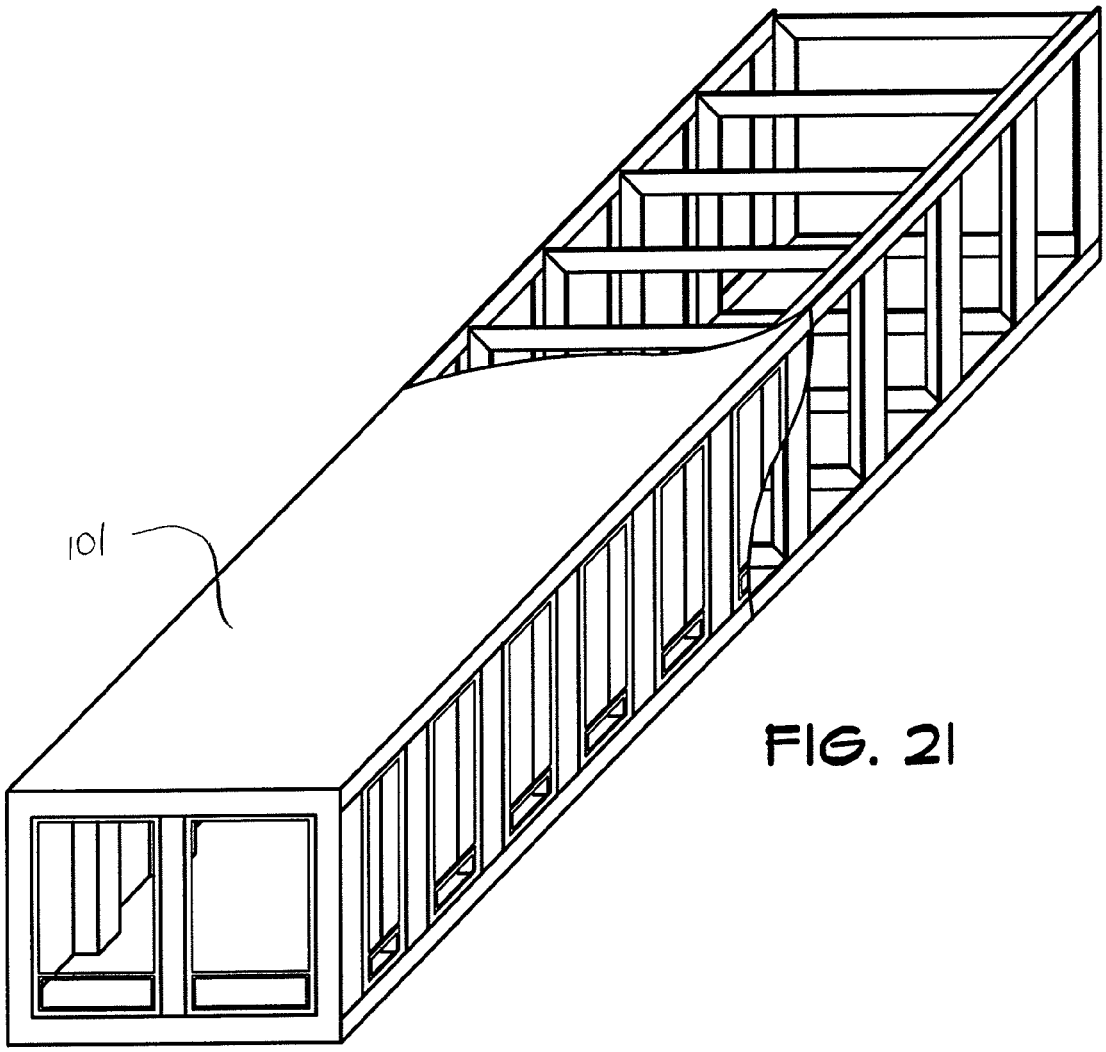
FIG. 21 is a partially deconstructed isometric showing a module with an example of sheathing and windows attached to the module.
Figure 22:
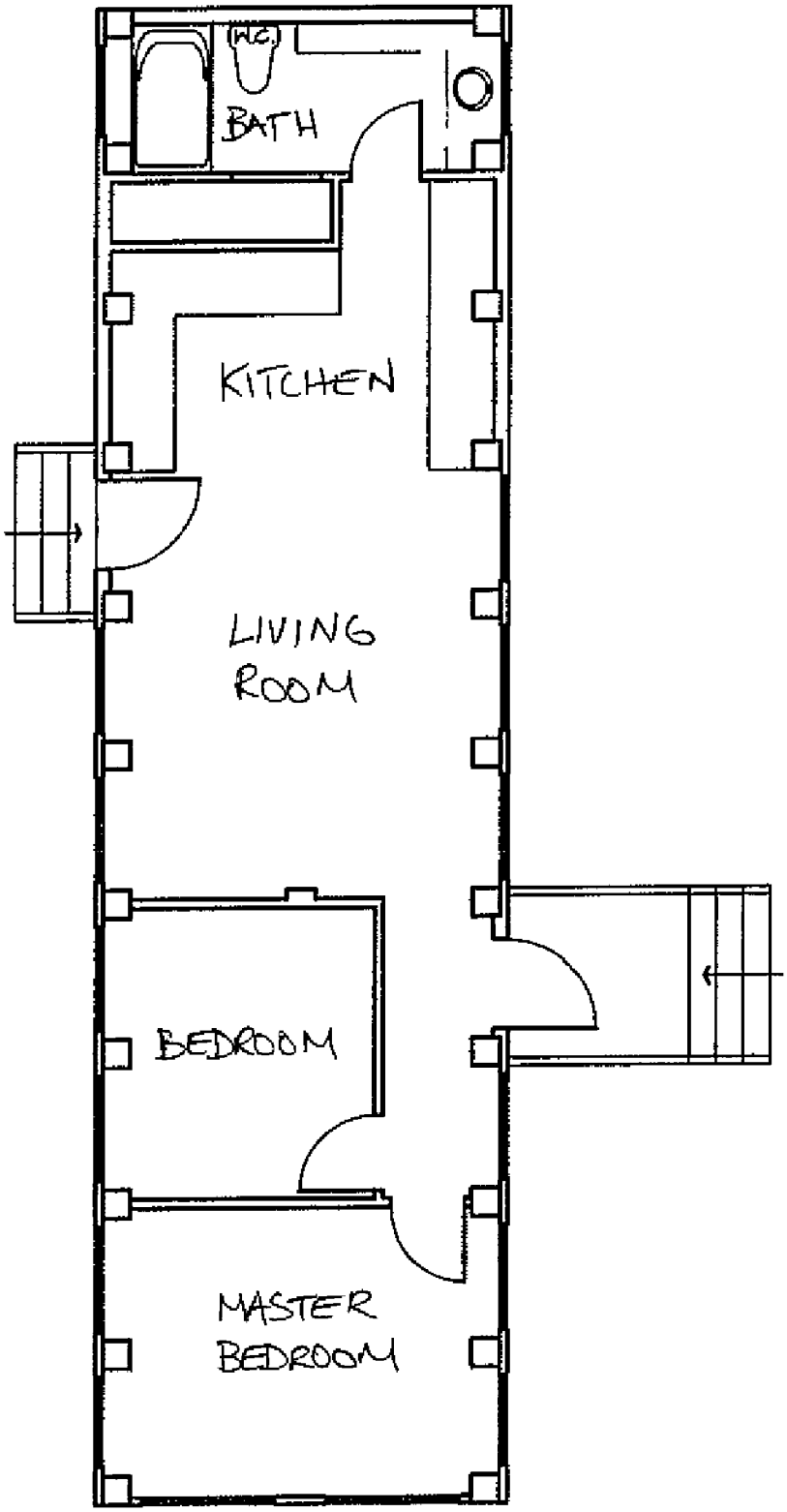
FIG. 22 is an example floor plan of a single module.

FIG. 20 shows the assembly as described in FIGS. 18 and 19 from the direction facing the ribs. This drawing is pertinent for both alternates 1 and 2 of the rib conditions. FIG. 21 is an isometric showing a partially deconstructed module. The drawing shows a finished module in the front, with the exposed structure at the rear. FIG. 22 shows an example of a floor plan configuration for the module. The design possibilities for floor plans as well as elevations are endless and will be dictated by marketplace and architect and customer preferences.

Figure 23:
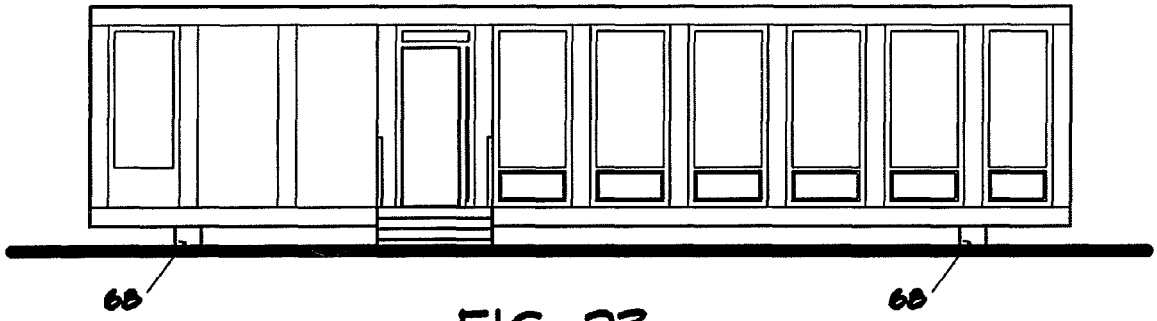

FIG. 23 is an elevation of the module with the floor plan shown in FIG. 22. The elevation also shows the support points of the module (element 68); in this embodiment being 5'-0" from each end. The Vierendeel truss is designed to be supported at these points on either concrete piers, attached with hot or cold rolled metal connectors or metal supports such as Tiedown or equal, each with a downward support and uplift resistance dictated by the size of the unit. The support points are also the location of wheels attached to the Vierendeel truss used to transport the unit. The connections for the supports to wheels will be determined also by the size of the module.

Figure 24:
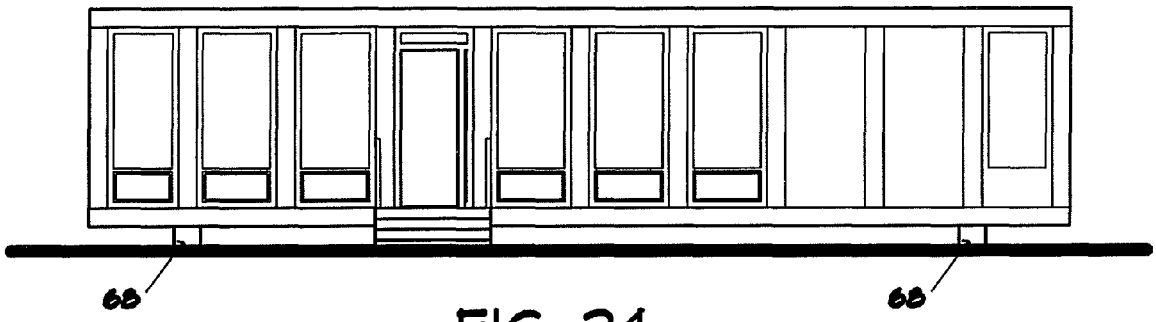
FIGS. 23 and 24 are example elevations of a single module.
Figure 25:
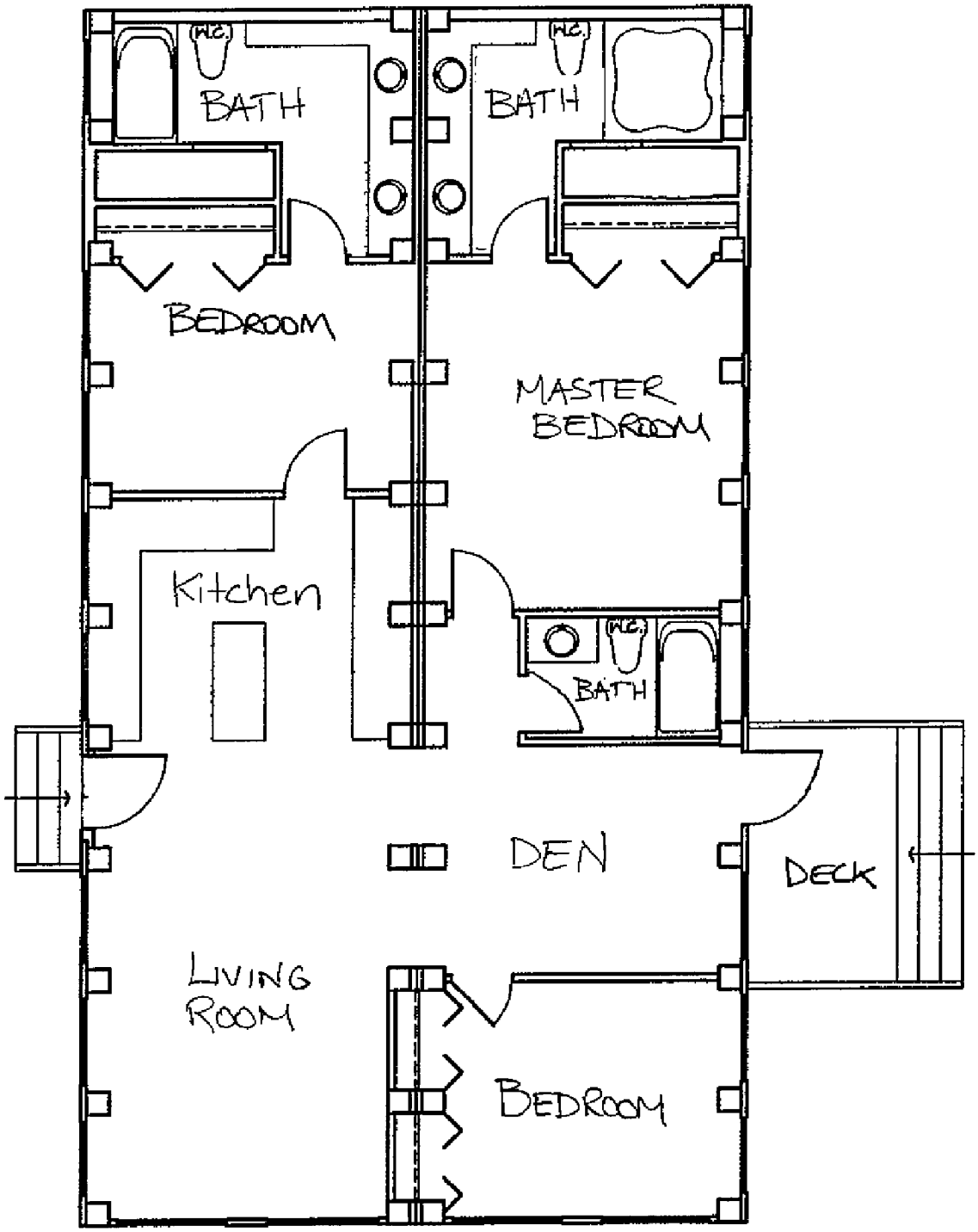
FIG. 25 is an example floor plan of a double module.

FIG. 24 is an elevation from the opposite side of the module, showing the supports (element 68) per specifications as highlighted in FIG. 23. FIG. 25 is a floor plan showing the example of a double module. As with the single module, the design possibilities for floor plans as well as elevations are endless and will be dictated by marketplace and architect and customer preferences. The double module highlights the flow from one unit to the other enhanced by the open configuration of the Vierendeel truss. The two modules could actually be open the entire length of the units with the supports at, in this embodiment, 5'-0" on center. If modules are connected at the short ends, the opening may be the entire width of the interior of the rib, similar to the opening at each rib point of the interior of the module.

In another embodiment, cubic rib structures can be used. In this embodiment, a pair of ribs 15 are coupled together by use of a single span truss structure to laterally space the ribs 15 and to form the cubic rib structure. Using this arrangement, each cubic rib structure would need to have each bottom corner supported by a concrete footing. This arrangement would allow different shape configurations as desired.

In another embodiment a second wind force resistant structure is positioned next to a first wind force resistant structure to form a single unit structure that have a combined interior region. This arrangement results in a double wide structure that results in a larger living facility. In yet another embodiment, a third wind force resistant structure is positioned on top of one of the first or second wind force resistant structures, or between the two to form a multi-story single unit structure that have a combined interior region. This arrangement would allow for a multi-story dwelling while still having favorable wind resistant characteristics.

The wind force resistant structure is secured by use of concrete footings that are positioned below the frost line for a given region, as shown, for example, in FIGS. 23 and 24. The footings are secured to the Vierendeel truss by straps or plates. In order to provide additional reinforcement, a steel I-beam, railroad rail or similar type structure can extend between the footings and the Vierendeel truss is coupled to the beam. This arrangement prevents the entire structure from being lifted or moved from a desired location by prevailing winds.

In another embodiment, the wind force resistant structure can be used as a core structure inside a large building design. Under this concept, additional rooms, porches and the like would be built around the wind force resistant structure. These additional structures would be sacrificial in that they would be damaged during a wind storm but would serve to shelter the wind force resistant structure. This design would be helpful for ranches and other dwellings that do not have a basement.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wind force resistant structure comprising:

a first side wall and a spaced apart second side wall, the side walls including spaced apart horizontal members, a series of laterally spaced vertical members and a series of connector plates that are used to couple the vertical members to the horizontal members to form the first and second side walls;

a series of laterally spaced rib structures that include spaced apart top and bottom members, and first and second side members, wherein the top and bottom members are coupled to the first and second side members to form the rib structures; and wherein the rib structures are coupled the first and second side walls at the vertical members by a series of connectors to form a monolithic structure.

2. The wind force resistant structure of claim 1, wherein the top and bottom members and first and second side members of the rib structures are coupled together by a series of plates.

3. The wind force resistant structure of claim 2, wherein the rib structures are coupled to the first and second walls by use of brackets.

4. The wind force resistant structure of claim 3, wherein a top side of the monolithic structure is covered with a plywood sheeting.

5. The wind force resistant structure of claim 1, wherein one of the first and second side walls includes at least one door and at least one window.

6. The wind force resistant structure of claim 1, wherein the first and second side walls are coupled to a series of concrete footings to secure the structure.

7. The wind force resistant structure of claim 3, wherein the brackets are coupled to the plates of the rib structures and to the truss plates of the first and second side walls.

8. The wind force resistant structure of claim 1, wherein the horizontal and vertical members of the first and second walls are formed from 2×12 standard grade lumber.

9. The wind force resistant structure of claim 8, wherein the ribs are formed from 2×12 standard grade lumber.

10. The wind force resistant structure of claim 1, further including floor joists that are oriented transverse to the ribs.

11. The wind force resistant structure of claim 10, wherein the floor joists are laterally spaced and span between the ribs.

12. The wind force resistant structure of claim 11, wherein the floor joists and the bottom members of the ribs are covered with plywood sheeting.

13. A wind force resistant structure comprising:

a pair of laterally spaced sidewalls formed from a pair of horizontal members, a series of laterally spaced vertical members, and a series of connector plates that connect the vertical members to the horizontal members;

a series of laterally spaced rib members that are formed from top and bottom members that are coupled to first and second side members by connector plates, the rib members configured to be coupled to the sidewalls by brackets and positioned to lie near the vertical members; and floor joists extending between the bottom members of adjacent ribs to form a floor structure.

14. The wind force resistant structure of claim 13, wherein a top side of the wind force resistant structure is covered with plywood sheeting.

15. The wind force resistant structure of claim 13, wherein one of the first and second side walls includes at least one door and at least one window.

16. The wind force resistant structure of claim 13, wherein the first and second side walls are coupled to a series of concrete footings to secure the structure.

17. The wind force resistant structure of claim 13, wherein the horizontal and vertical members of the first and second walls are formed from 2×12 standard grade lumber.

18. The wind force resistant structure of claim 13, wherein the ribs are formed from 2×12 standard grade lumber.

19. The wind force resistant structure of claim 13, wherein the floor joists and the bottom members of the ribs are covered with plywood sheeting.

20. The wind force resistant structure of claim 13, wherein a second wind force resistant structure is positioned to lie near the first wind force resistant structure to form a single unit structure that have a combined interior region.

21. The wind force resistant structure of claim 20, wherein a third wind force resistant structure is positioned on top of one of the first or second wind force resistant structures to form a multi-story single unit structure that have a combined interior region.

* * * * *